US008636039B2

(12) United States Patent
Litten et al.

(10) Patent No.: US 8,636,039 B2
(45) Date of Patent: Jan. 28, 2014

(54) METHODS, DEVICES AND SYSTEMS FOR REFILLING A FLUID DISPENSER

(75) Inventors: Neil Anthony Litten, Egham (GB); Lucas Boalem Nanini-Maury, London (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/369,320

(22) Filed: Feb. 9, 2012

(65) Prior Publication Data

US 2012/0205401 A1 Aug. 16, 2012

Related U.S. Application Data

(60) Provisional application No. 61/441,874, filed on Feb. 11, 2011.

(51) Int. Cl.

| | |
|---|---|
| ***B65B 1/16*** | (2006.01) |
| ***B67D 7/70*** | (2010.01) |
| ***B67D 7/64*** | (2010.01) |

(52) U.S. Cl.

USPC ..... 141/22; 141/2; 222/255; 222/288; 222/402.16

(58) Field of Classification Search

USPC ..... 222/252, 255, 282–283, 287–288, 222/321.7, 321.9; 141/2, 3, 18, 20–22, 113

See application file for complete search history.

(56) References Cited

U.S. PATENT DOCUMENTS

| | | | |
|---|---|---|---|
| 3,131,733 | A | 5/1964 | Monahon |
| 3,181,737 | A | 5/1965 | Chaucer |
| 3,337,091 | A | 8/1967 | Bartels |
| 3,357,603 | A | 12/1967 | Kitabayashi |
| 3,363,810 | A | 1/1968 | Meshberg |
| 3,365,105 | A | 1/1968 | Krizka |
| 3,366,148 | A | 1/1968 | Mizuguchi |
| 3,559,701 | A | 2/1971 | Wittersheim et al. |

(Continued)

FOREIGN PATENT DOCUMENTS

| | | | |
|---|---|---|---|
| BE | 759957 | A2 | 5/1971 |
| DE | 1400737 | A1 | 10/1968 |

(Continued)

OTHER PUBLICATIONS

International Search Report, PCT/US2012/024417 dated Apr. 26, 2012, 14 pages.

*Primary Examiner* — Paul R Durand
*Assistant Examiner* — Charles P Cheyney
(74) *Attorney, Agent, or Firm* — James C. Vago

(57) ABSTRACT

A fluid dispensing system including a parent dispenser and a child dispenser, wherein the parent dispenser has a parent body with a parent reservoir containing fluid, a first magnetic coupling member, a passage, a parent pump mechanism and a parent actuator. The parent actuator has an outlet, a second magnetic coupling member, and actuator inlet tube. The actuator inlet tube is removably received within the passage. The first and second magnetic coupling members cooperate to removably couple the parent actuator and the parent body. The child dispenser has a child body with a child reservoir, a child pump mechanism, and a child inlet tube. The child inlet tube is removably received within the passage when the child dispenser is coupled to the parent body. When the child dispenser is coupled to the parent body, the parent pump is actuated to transfer fluid from the parent to the child reservoir.

24 Claims, 12 Drawing Sheets

(56) References Cited

U.S. PATENT DOCUMENTS

| | | | | |
|---|---|---|---|---|
| 3,613,960 | A | 10/1971 | Beard | |
| 3,718,165 | A * | 2/1973 | Grothoff | 141/20 |
| 3,817,297 | A | 6/1974 | King | |
| 4,093,123 | A | 6/1978 | Maran | |
| 4,174,811 | A | 11/1979 | Binder et al. | |
| 4,473,097 | A | 9/1984 | Knickerbocker et al. | |
| 4,570,532 | A | 2/1986 | Labelle | |
| 5,179,982 | A | 1/1993 | Berube et al. | |
| 5,343,904 | A | 9/1994 | Kaeser | |
| 5,388,620 | A | 2/1995 | Lasserre et al. | |
| 5,524,468 | A | 6/1996 | Jentzsch et al. | |
| 5,524,680 | A * | 6/1996 | de Laforcade | 141/18 |
| 5,791,527 | A | 8/1998 | Giuffredi | |
| 5,819,986 | A | 10/1998 | Last et al. | |
| 5,832,965 | A | 11/1998 | Fasse et al. | |
| 6,418,978 | B2 * | 7/2002 | Bailly | 141/2 |
| 6,435,231 | B1 | 8/2002 | Cooper et al. | |
| 6,533,482 | B1 | 3/2003 | Byun | |
| 6,607,012 | B2 | 8/2003 | Yquel | |
| 6,681,961 | B2 | 1/2004 | Pares Montaner et al. | |
| 6,857,806 | B2 | 2/2005 | Harrison et al. | |
| 6,863,093 | B2 | 3/2005 | Garcia et al. | |
| 7,066,674 | B2 | 6/2006 | Gueret | |
| 7,377,296 | B2 | 5/2008 | Gueret | |
| 7,870,977 | B2 | 1/2011 | Pietrowski et al. | |
| 8,079,388 | B2 | 12/2011 | Turgeman | |
| 2004/0076462 | A1 | 4/2004 | Grandmottet | |
| 2011/0309113 | A1 | 12/2011 | Hui et al. | |

FOREIGN PATENT DOCUMENTS

| | | | |
|---|---|---|---|
| DE | 7726313 | U1 | 11/1977 |
| DE | 7807554 | U1 | 7/1978 |
| DE | 2744892 | A1 | 4/1979 |
| DE | 3111571 | A1 | 10/1982 |
| DE | 9013487 | U1 | 11/1990 |
| DE | 29500893 | U1 | 3/1995 |
| DE | 19613891 | A1 | 10/1997 |
| EP | 0 410 947 | B1 | 3/1994 |
| EP | 2335833 | A1 | 6/2011 |
| FR | 2311593 | A1 | 12/1976 |
| FR | 2841159 | B1 | 4/2007 |
| FR | 2886633 | B1 | 9/2007 |
| FR | 2893598 | B1 | 2/2008 |
| GB | 938331 | A | 10/1963 |
| GB | 1311940 | A | 3/1973 |
| GB | 2 095 103 | A | 9/1982 |
| GB | 2 137 181 | A | 10/1984 |
| GB | 2 229 380 | A | 9/1990 |
| WO | 91/01257 | A1 | 2/1991 |
| WO | 94/03380 | A1 | 2/1994 |
| WO | 9934930 | A1 | 7/1999 |
| WO | 02/052977 | A2 | 7/2002 |
| WO | 2005/101969 | A2 | 11/2005 |
| WO | 2010/094963 | A1 | 8/2010 |
| WO | 2012/025758 | A2 | 3/2012 |

* cited by examiner

METHODS, DEVICES AND SYSTEMS FOR REFILLING A FLUID DISPENSER

CROSS REFERENCE TO RELATED APPLICATION

This application claims the benefit of U.S. Provisional Application No. 61/441,874 filed Feb. 11, 2011.

FIELD OF THE INVENTION

The present invention relates to methods, devices, and systems for refilling a fluid dispenser, such as a perfume dispenser.

BACKGROUND OF THE INVENTION

Perfume dispensers are known in the art. Many perfume dispensers are bulky and ill suited for convenient storage in small purses, handbags, and the like. One solution is to provide a perfume dispenser that is conveniently sized for storage in a purse or handbag. The small size of such a perfume dispenser, however, limits the amount of liquid perfume that it can store. Therefore, it is often desirable that these smaller perfume dispensers have the ability to be refilled from a larger reservoir. It is also often desirable that the reservoir is provided in the form of a perfume dispenser that also has the ability to apply an atomized perfume when desired, thereby providing a convenient applicator for use in the home. Some examples of perfume refilling systems are described in WO 02/052977 and WO 2005/101969. While these devices may be satisfactory for their intended purpose, a continuing challenge is to provide two perfume dispensers that can atomize a liquid perfume for application by a user, one of which is travel sized and can be conveniently and easily refilled from the other dispenser without spraying, undesirable spilling or accidental discharge of the liquid perfume during the refilling process.

SUMMARY OF THE INVENTION

A fluid dispensing system including a parent dispenser and a child dispenser is provided. The parent dispenser has a parent body with a parent reservoir containing a fluid, a first magnetic coupling member, a passage, and a parent pump mechanism in fluid communication with the parent reservoir and the passage. The parent dispenser also includes a parent actuator for actuating the parent pump mechanism, the parent actuator having an outlet, a second magnetic coupling member, and an actuator inlet tube in fluid communication with the outlet, wherein the actuator inlet tube is removably received within the passage and wherein the first magnetic coupling member and the second magnetic coupling member cooperate to removably couple the parent actuator and the parent body. The child dispenser has a child body with a child reservoir, a child pump mechanism, and a child inlet tube, wherein the child inlet tube is removably received within the passage when the child dispenser is coupled to the parent body. The child dispenser also includes a child actuator for actuating the child pump mechanism. The parent pump mechanism is actuatable by the child dispenser when the child dispenser is coupled to the parent body to transfer at least some of the fluid from the parent reservoir to the child reservoir.

DETAILED DESCRIPTION OF THE INVENTION

The present invention will now be described with occasional reference to some specific embodiments of the invention. The invention may, however, be embodied in different forms and should not be construed as limited to the embodiments set forth herein. Additionally, the disclosure of any ranges in the specification and claims are to be understood as including the range itself and also anything subsumed therein, as well as endpoints. All numeric ranges are inclusive of narrower ranges; delineated upper and lower range limits are interchangeable to create further ranges not explicitly delineated. Unless otherwise indicated, the numerical properties set forth in the specification and claims are approximations that may vary depending on the desired properties sought to be obtained in embodiments of the present invention.

The present invention provides a novel and unique liquid refilling system comprising a parent liquid dispenser and a child or traveler liquid dispenser that can be removably coupled to the parent dispenser to transfer liquid there between. The parent dispenser utilizes an easily removable/attachable actuator configuration that minimizes and/or eliminates undesirable spilling and spraying of the liquid perfume during the refilling process. As used herein, the term "liquid perfume" refers to any liquid composition incorporating a fragrance compound. Any fragrance compound, or combinations of compounds, may be employed with the present invention. In some embodiments, the fragrance compounds may be derived from any suitable plant or synthetic material. Some non-limiting examples of liquid perfumes are described in U.S. Pat. Nos. 7,413,731; 7,208,464; and 7,763,742. While the present invention will be described herein with reference to the use of liquid perfume for purposes of illustration, it will be appreciated that other liquids may be used with the present invention. For example, any cosmetic, skin care, grooming, body care, or oral care liquid may be also be used. Some non-limiting examples include after shaves, UV skin care compositions, skin care moisturizers, hand sanitizing compositions, and mouth rinses, some non-limiting examples of which are described in U.S. Pat. Nos. 5,883,059 and 2005/0169852.

Figure 1A:
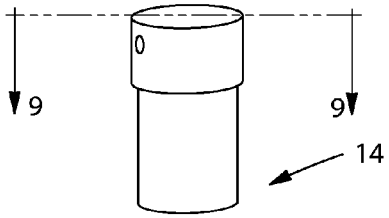
FIG. 1A is a perspective view of one embodiment of a child dispenser suitable for use with the parent dispenser of FIG. 1.
Figure 1:
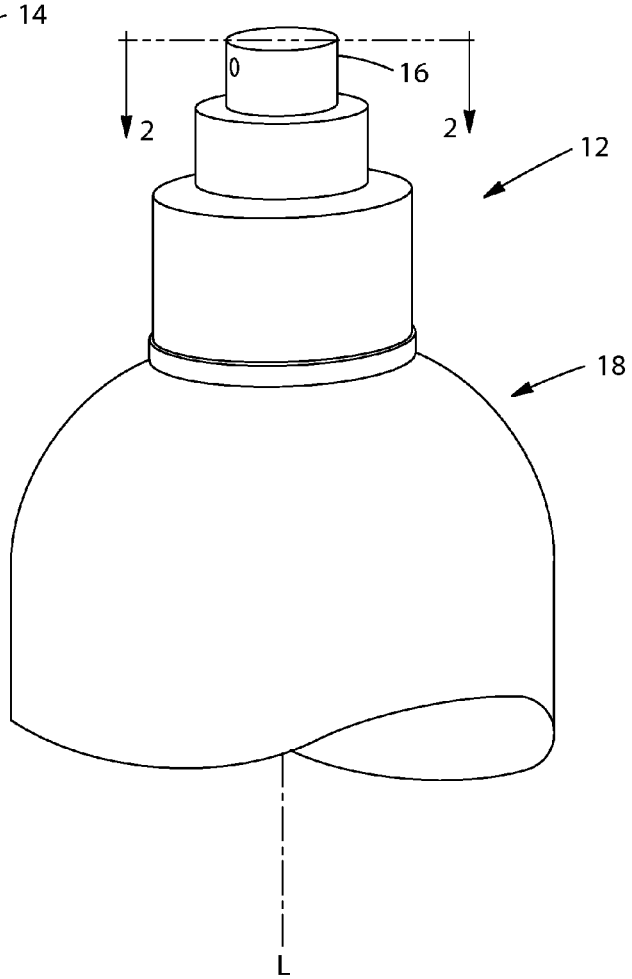
FIG. 1 is a perspective view of one embodiment of the present invention comprising a parent dispenser.
Figure 2:
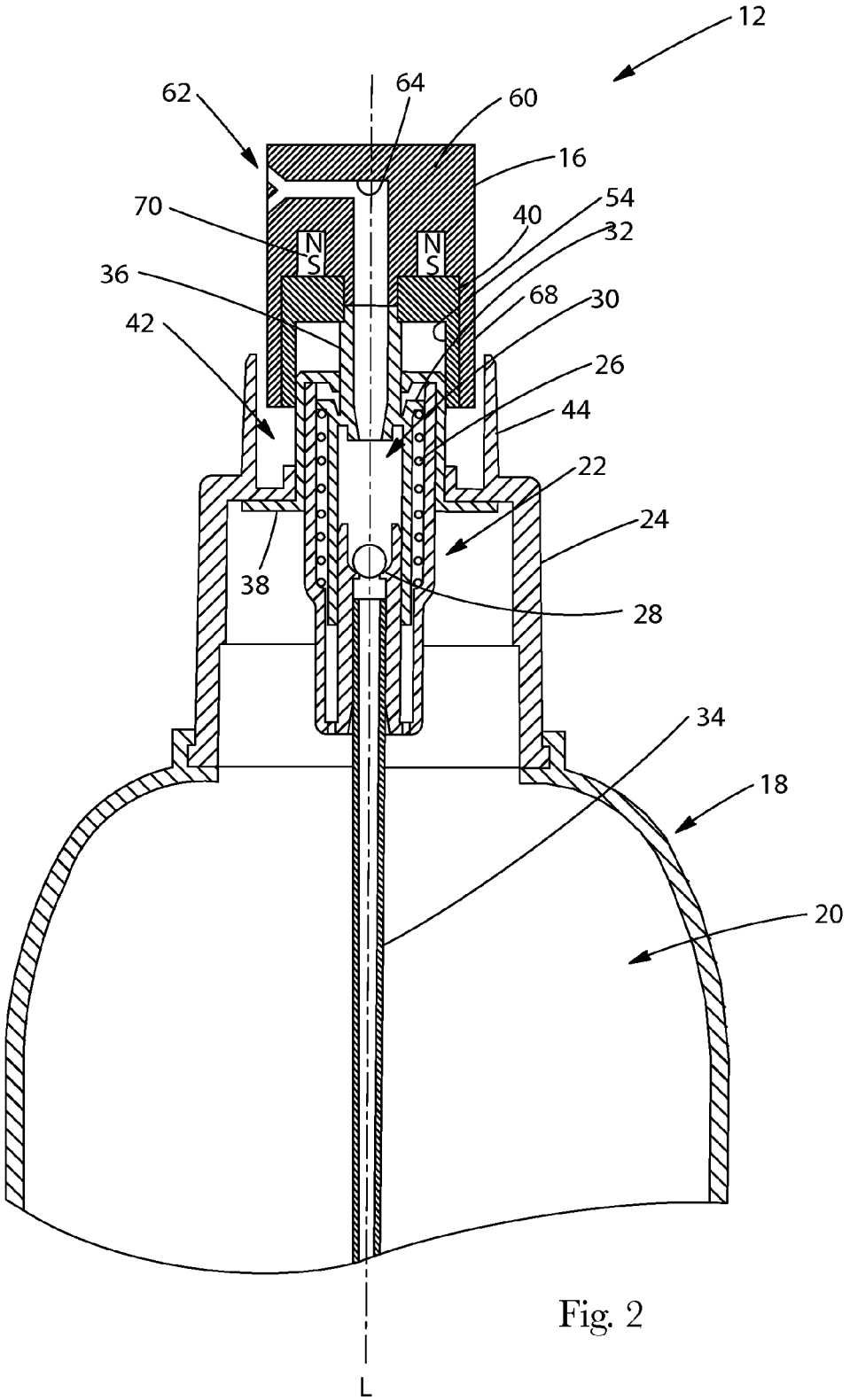
FIG. 2 is a cross sectional view of the parent dispenser of FIG. 1, taken along line 2-2 thereof.
Figure 3:
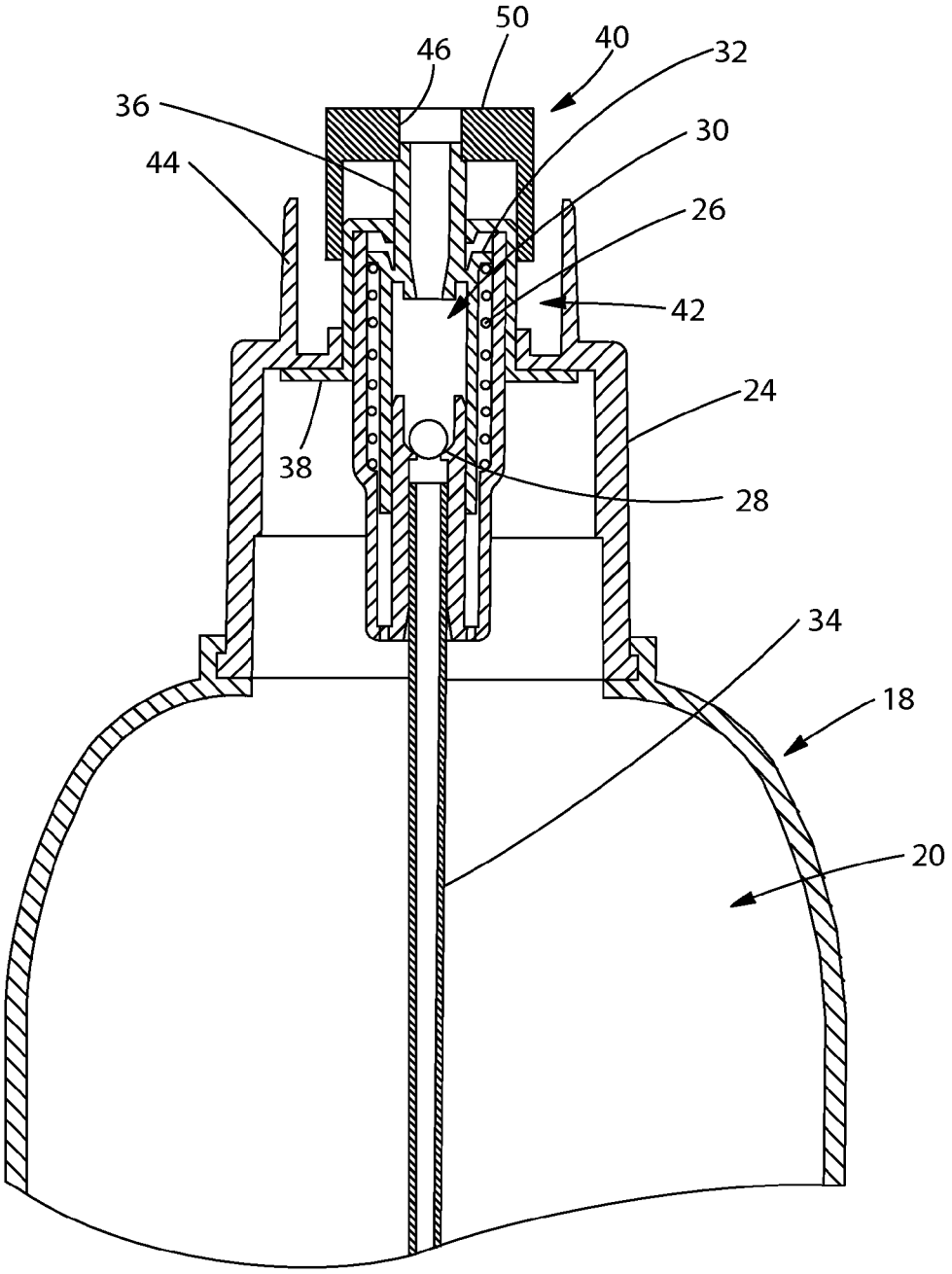
FIG. 3 is a perspective view of magnetic coupling member and a parent body of the parent dispenser of FIG. 2.
Figure 4:
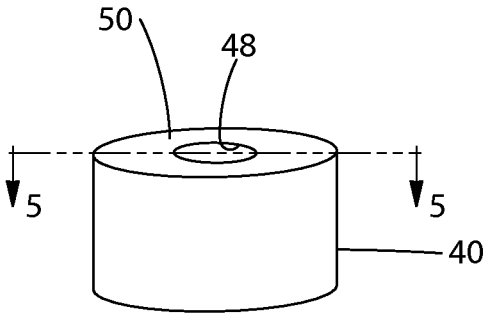
FIG. 4 is perspective view of the magnetic coupling member of FIG. 3.

Referring to FIGS. 1 and 1A, one embodiment of a liquid refilling system comprising a parent dispenser 12 (FIG. 1) and a child dispenser 14 (FIG. 1A) are illustrated. The parent dispenser 12 comprises a parent actuator 16 removably coupled to a parent body 18. Referring to FIGS. 2 and 3, the parent body 18 comprises a parent fluid reservoir 20 for storing a liquid perfume (not shown). The volumetric capacity of the parent fluid reservoir 20 can vary widely depending upon the intended use and the nature of liquid stored in the parent fluid reservoir 20. In some liquid perfume embodiments, the parent fluid reservoir 20 has a fluid capacity greater than 30 ml, or 50 ml, or 75 ml and/or less than 300 ml, or 150 ml, or 100 ml. A parent pump mechanism 22 may be provided within a neck or collar 24 of the parent body 18. While the parent pump mechanism 22 is shown as disposed within the collar 24 in FIGS. 2 and 3, it will be appreciated that the pump mechanism can be located elsewhere within the parent body 18, such as within the reservoir 20. In the illustrated embodiment, the pump mechanism 22 is provided as a spring biased positive displacement pump comprising a spring 26, a one-way ball valve 28, a pump chamber 30, and a plunger 32. A dip tube 34 is attached to the pump mechanism 22 and extends into the reservoir 20 for drawing the liquid perfume from the reservoir 20. The liquid perfume is discharged from the pump mechanism 22 thru a discharge tube 36 that may be integrally formed with the plunger 32. The pump mechanism 22 may be captured or attached to a fitting 38 that is in turn attached to the collar 24. In some embodiments, the actuation force for the pump mechanism (i.e., the force required to begin to displace the plunger 32 against the biasing force of the spring 26) is between about 3 N and about 10 N. In other embodiments, the actuation force is between about 5 N and about 8 N. It will be appreciated that the pump mechanism 22 may be provided in wide variety of other configurations. For example, a diaphragm pump might be substituted, other inlet valve configurations might be provided, an outlet valve might be provided, the pump mechanism might be attached to the parent body 18 in a different manner, etc. In some embodiments where the fluid is a liquid perfume, the parent pump mechanism and/or the child pump mechanism are configured to pump between about 0.05 ml and about 0.15 ml per stroke of the pump mechanism. Some non-limiting examples of suitable pump mechanisms are also described in U.S. Pat. Nos. 7,870,977 and 6,681,961.

Referring to FIGS. 3-6, a first magnetic coupling member 40 associated with the parent body 18 will now be described. The first magnetic coupling member 40 is slidably disposed within an annulus 42 formed between fitting 38 and an upstanding wall 44 of the collar 44. The first magnetic coupling member 40 may be attached to the discharge tube 36 of the pump mechanism 22 in a variety of ways known in the art, such as by an adhesive, interference fit, welding, or it may be formed integrally with the discharge tube 36 by injection molding or other polymer/plastic forming process. In one embodiment, the first magnetic coupling member 40 is cylindrically shaped and comprises a passage 46 that has an opening 48 formed in the circular top surface 50 of the first magnetic coupling member 40. The passage 46 preferably has an inside diameter between about 1.3 mm and about 5 mm for removably receiving an inlet tube 52 of the parent actuator 16 as well as the discharge tube 36 of the pump mechanism. While the discharge tube 36 is illustrated as extending into the passage 46, it will be appreciated that the first magnetic coupling member 40 and the discharge tube 36 may be configured and/or connected in many other ways. For example, as shown in FIG. 7 the inside wall of the passage 46 of the magnetic coupling may be stepped so that the inside wall of the discharge tube of the pump mechanism 22 is flush with the inside wall of the passage 46 when they are connected. Likewise, the inside wall of the inlet tube 52 may also be flush with the inside wall of the passage 46. The first magnetic coupling member 40 has bore 54 that is sized to receive the fitting 38 or the upper portion of the pump mechanism 22.

Figure 5:
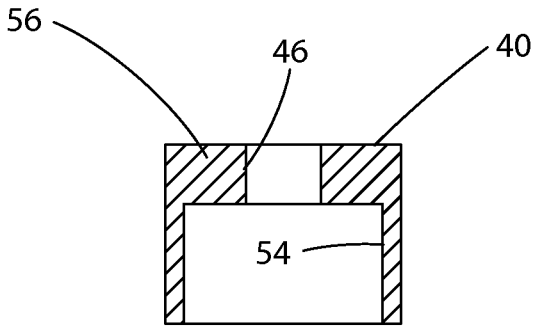
FIG. 5 is a cross sectional view of the magnetic coupling member of FIG. 4 taken along line 5-5 thereof.
Figure 8:
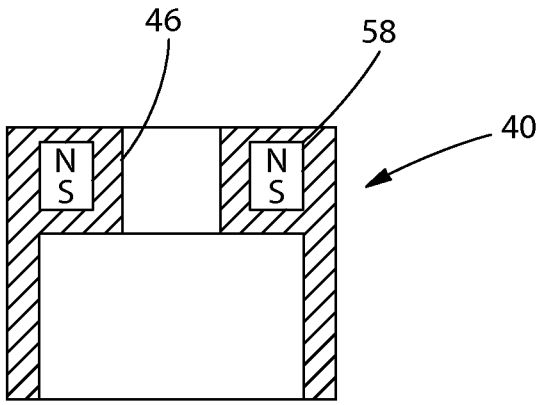
FIG. 8 is a cross sectional view of another configuration of the magnetic coupling member of FIG. 4, wherein the magnetic coupling member is provided as a plurality of magnets.

Referring to FIGS. 5 and 8, the first magnetic coupling member 40 is made, in whole or part, from a ferromagnetic material 56 (FIG. 5). In an alternate embodiment, the first magnetic coupling is provided in the form of one or more permanent or semi-permanent magnets 58 (FIG. 8). A ferromagnetic material is any material that is attracted to or repelled by a magnet. Some examples of ferromagnetic materials include iron, nickel, cobalt, rare earth metals, and any composition, material, alloy, or coating incorporating one of these materials. Non-metallic ferromagnetic materials may also be used. The magnet 58 can be formed from any material that produces a permanent or semi-permanent magnetic field sufficient enough to attract the ferromagnetic material 56 when the ferromagnetic material is brought in proximity to the magnet. The magnet 58 can be provided in a wide variety of geometric forms, including a bar, ring, cylinder, etc. While two discrete magnets 58 are shown in FIG. 8, it will be appreciated that more or less than two magnets may be provided and that the orientation of the poles of the magnets 58 can be varied. Further, while two discrete magnets are illustrated, it will be appreciated that the magnet 58 may be integrally formed with a structure or component of the parent body 18. For example, discrete magnetic particles or powders may be combined with one or more polymers or resins to form all or a portion of a component of the parent body during a molding process.

Figure 6:
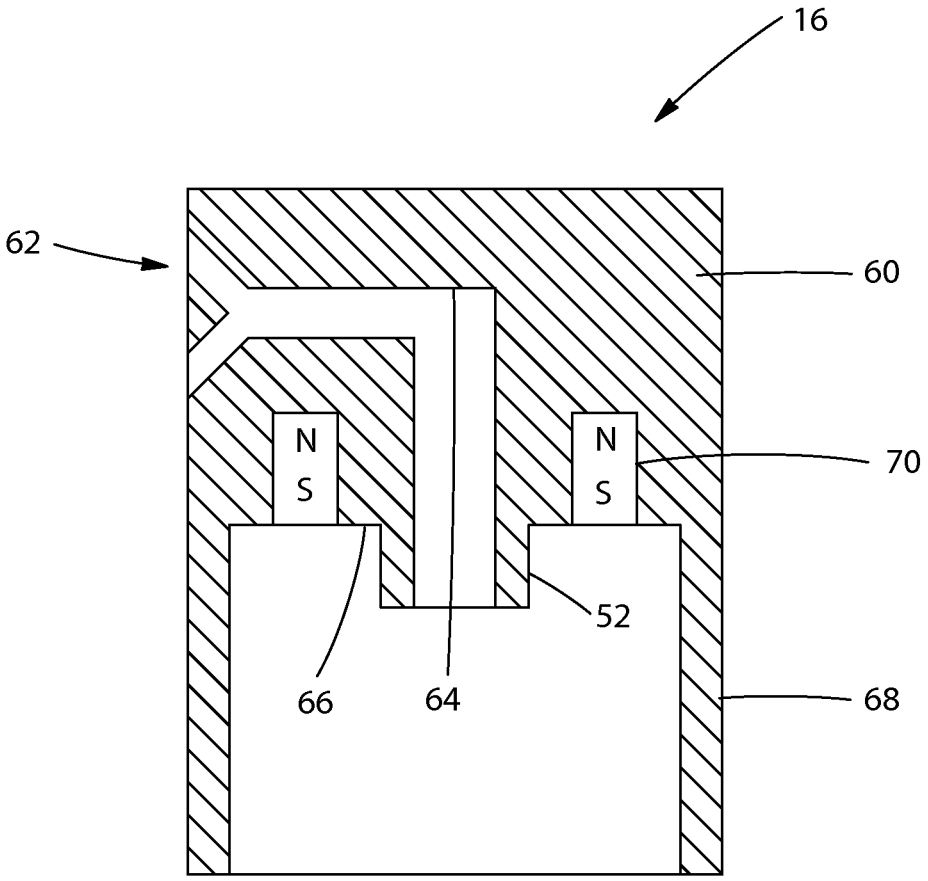
FIG. 6 is a cross sectional view of the actuator of the parent dispenser of FIG. 2.
Figure 7:
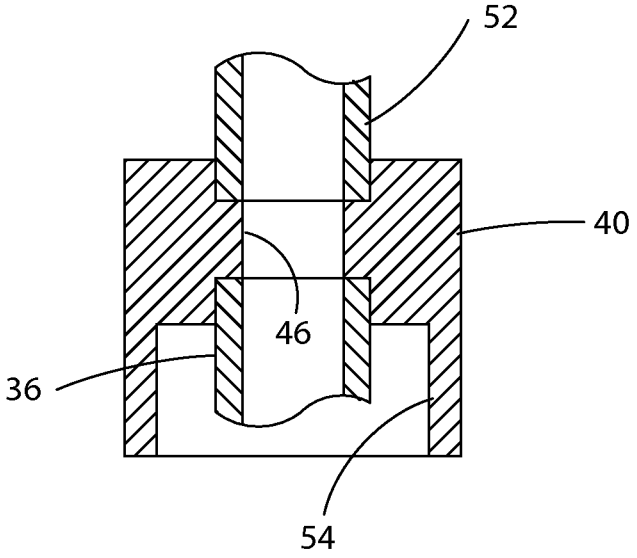
FIG. 7 is a cross sectional view of another configuration of the magnetic coupling member of FIG. 4.

Referring to FIG. 6, the parent actuator 16 comprises an actuator body 60 having an outlet 62. The inlet tube 52 is attached to the actuator body 60 and may be provided as a separate piece or formed integrally with the actuator body or some other piece of the parent actuator 16. The inlet tube 52 (and mating passage 46 as well as discharge tube 36) can be provided in a variety of geometric configurations, including non-cylindrical. The parent actuator 16 may further comprise a nozzle for atomizing the fluid dispensed from the parent actuator 16. A variety of nozzle configurations can be provided as known in the art. In some embodiments, vanes, swirl chambers, or impingement structures may be used in the nozzle to atomize the fluid. The outlet 62 is in fluid communication with the inlet tube 52 such that fluid may flow from the inlet tube 52 to the outlet 62. One or more conduits 64 may interconnect the inlet tube 52 and the outlet 62. The inlet tube 52 may extend below a bottom surface 66 of the actuator body 60. A downwardly depending skirt 68 may encircle the inlet tube 52.

The parent actuator 16 further comprises a second magnetic coupling member 70, wherein the second magnetic coupling member 70 is provided as one of a ferromagnetic material or one or more permanent or semi-permanent magnets. FIG. 6 illustrates an embodiment where the second magnetic coupling member is provided in the form of a plurality of magnets. The first magnetic coupling member 40 and the second magnetic coupling member 70 are configured complimentary so that the first magnetic coupling member 40 and the second magnetic coupling member 70 cooperate to releasably secure the parent actuator 16 to the parent body 18. In embodiments where the first magnetic coupling member 40 is provided in the form of a ferromagnetic material, the second magnetic coupling member 70 is provided in the form of a semi-permanent/permanent magnet (e.g., an example of which is illustrated in FIG. 6). In embodiments where the first magnetic coupling member 40 is provided in the form of a semi-permanent/permanent magnet, the second magnetic coupling member 70 is provided in the form of a ferromagnetic material. The second magnetic coupling member 70 may be provided in any of the wide variety of configurations previously described with respect to the first magnetic coupling member 40. In some embodiments, the ferromagnetic material or the magnet may be disposed adjacent the bottom surface 66 or form part of (or wholly form) the bottom surface 66. The second magnetic coupling member 70 may also be wholly or partially embedded within the parent actuator body 60.

As described previously, the first and second magnetic coupling members cooperate to releasably secure the parent actuator 16 to the parent body 18. In some embodiments, the first and second magnetic coupling members have a separation force (i.e., the force necessary to separate the first magnetic coupling member from the second magnetic coupling member) between about 0.75 N and about 5 N and in other embodiments the separation force is between about 1.5 N and about 3.75 N. In most cases, this is also the same force attracting the first magnetic coupling member to the second magnetic coupling member when the members are brought into non-contacting proximity of each other. Because of the attractive force generated between the first and second magnetic coupling members, the amount of external force transmitted by a user to the discharge tube 36 and plunger 32 while attaching the parent actuator 16 to the parent body 18 is minimal. Practically, this means that insufficient force is applied by a user when attaching the parent actuator 16 to the parent body 18 to actuate the pump mechanism 22 and pump fluid out of the outlet 62. In contrast, users attaching an actuator to parent body where a traditional latching mechanism is employed (e.g., an interference fit or interlocking tab and notch) may easily apply a force that results in an undesirable actuation of the pump mechanism while attempting to attach the actuator to the parent body. In addition, single handed removal of the actuator can be challenging with conventional actuator/parent body latching arrangements due to the high force required to separate the actuator from the body (sometimes in excess of 10 N). The low separation forces enabled by magnetic coupling can permit single handed removal of the parent actuator, which may be advantageous during a process of refilling a child dispenser (described hereafter).

When the parent actuator 16 is releasably coupled to the parent body 18, the pump mechanism 22 may be actuated by depressing the parent actuator 16 toward the parent body 18. As the parent actuator 16 is displaced downwardly toward the parent body 18, the discharge tube 36 and the plunger 32 are likewise displaced a similar distance. As the discharge tube 36 and plunger 32 are displaced toward the parent body, fluid within the pump chamber 30 is pressurized due to the decrease in volume of the pump chamber and seating of the ball valve 28. Fluid within the pump chamber 30 is then pumped thru the discharge tube 36, the passage 46, the inlet tube 52, and out of the outlet 62. Once the plunger 32 has bottomed (i.e., a complete downward stroke of the plunger has occurred), the biasing force generated by compression of the spring 26 will act to return the parent actuator 16 to its original position. As the parent actuator 16, discharge tube 36 and plunger 32 travel away from the parent body, the negative pressure generated by the volumetric expansion of the pump chamber 26 unseats the ball valve 28 and draws fluid thru the dip tube 34 from the reservoir 20 into the pump chamber 26, after which the pump mechanism 22 is primed for another pumping cycle.

Figure 9:
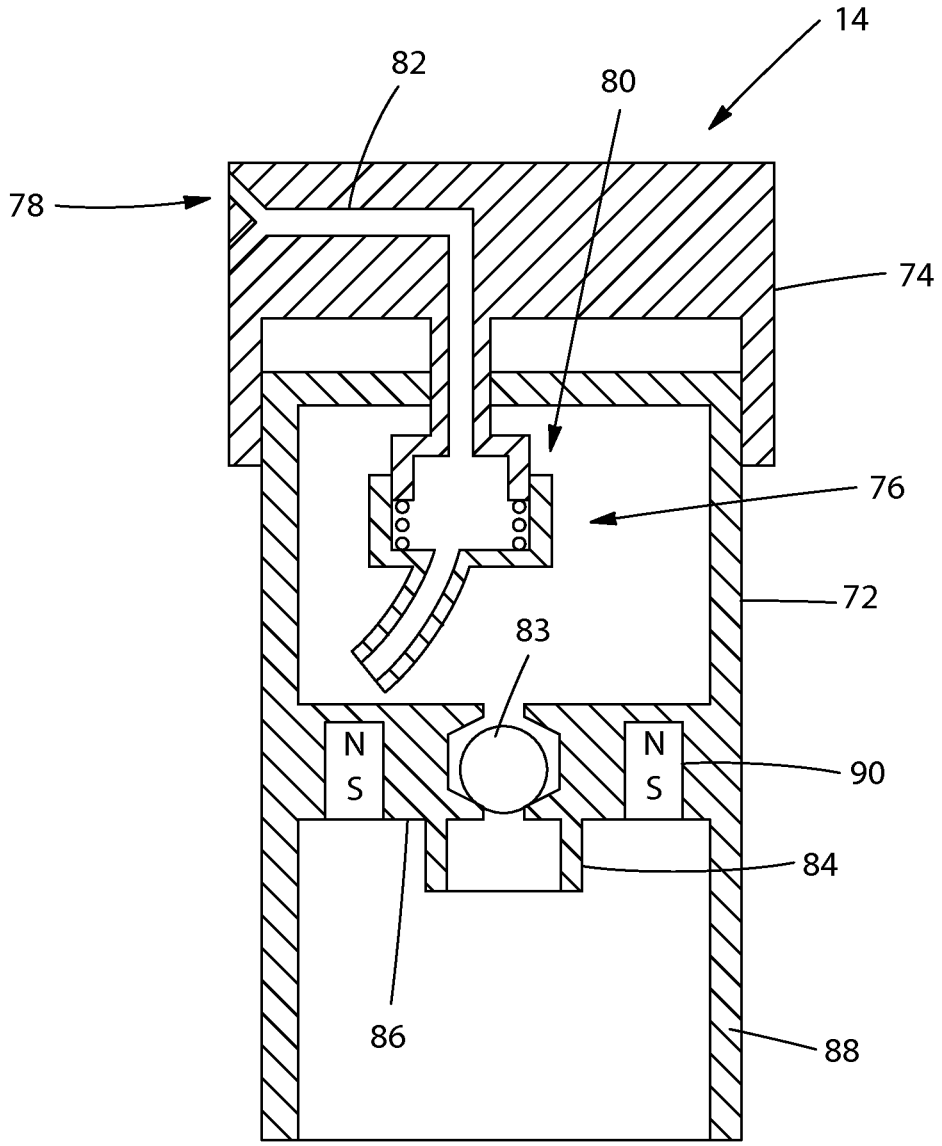
FIG. 9 is a cross-sectional view of the child dispenser of FIG. 1A, taken along line 9-9 thereof.

Referring to FIG. 9, one embodiment of a child dispenser will now be described. The child dispenser 14 comprises a child body 72 and a child actuator 74 movably attached to the child body 72. The child body 72 has a child reservoir 76 that is in fluid communication with an outlet 78 of the child actuator 74. The child reservoir 76 stores a fluid, such as a liquid perfume, that has been transferred from the parent reservoir 20 of the parent dispenser 12. In some embodiments, the child reservoir 76 has a fluid capacity between about 1 ml and about 10 ml, or between about 3 ml and about 7.5 ml, or between about 5 ml and about 7 ml. The child body 72 further comprises a child dispensing mechanism such as a child pump mechanism 80 for pumping fluid from the child reservoir 76 thru one or more conduits 82 to the outlet 78. In alternative embodiments, the dispensing mechanism may be any dispensing means known in the art such as a roller ball, sponge or flacon type stopper. A nozzle (not shown) may be provided just upstream of the outlet 78 for atomizing the fluid. The nozzle and child pump mechanism 80 may be provided in a wide variety of configurations as known in the art, including configurations the same as or similar to those described previously with respect parent actuator 16 and parent pump mechanism 22. A one-way valve 83 (shown in FIG. 9 as a ball valve) may be provided to regulate fluid flow into the child reservoir 76. The one-way valve 83 is in fluid communication with the child reservoir 76 and a child inlet tube 84 that depends downwardly from a bottom surface 86 of the child body 72. The child inlet tube 84 is configured so that it may be slidably received within the passage 46 when the child dispenser 14 is releasably coupled to the parent body 18. A downwardly depending skirt 88 may encircle the child inlet tube 84.

The child body 72 may optionally comprise a third magnetic coupling member 90. The first magnetic coupling member 40 and the third magnetic coupling member 90 are complimentary so that the first magnetic coupling member 40 and the third magnetic coupling member 90 magnetically cooperate to releasably secure the child dispenser to the parent body. In some embodiments, the third magnetic coupling member 90 has the same configuration as the second magnetic coupling member 70. For example, in an embodiment wherein the first magnetic coupling member 40 is provided in the form of a ferromagnetic material and the second magnetic coupling member 70 is provided in the form of a semi-permanent/permanent magnet, the third magnetic coupling member would also be provided in the form of a semi-permanent/permanent magnet.

Figure 10:
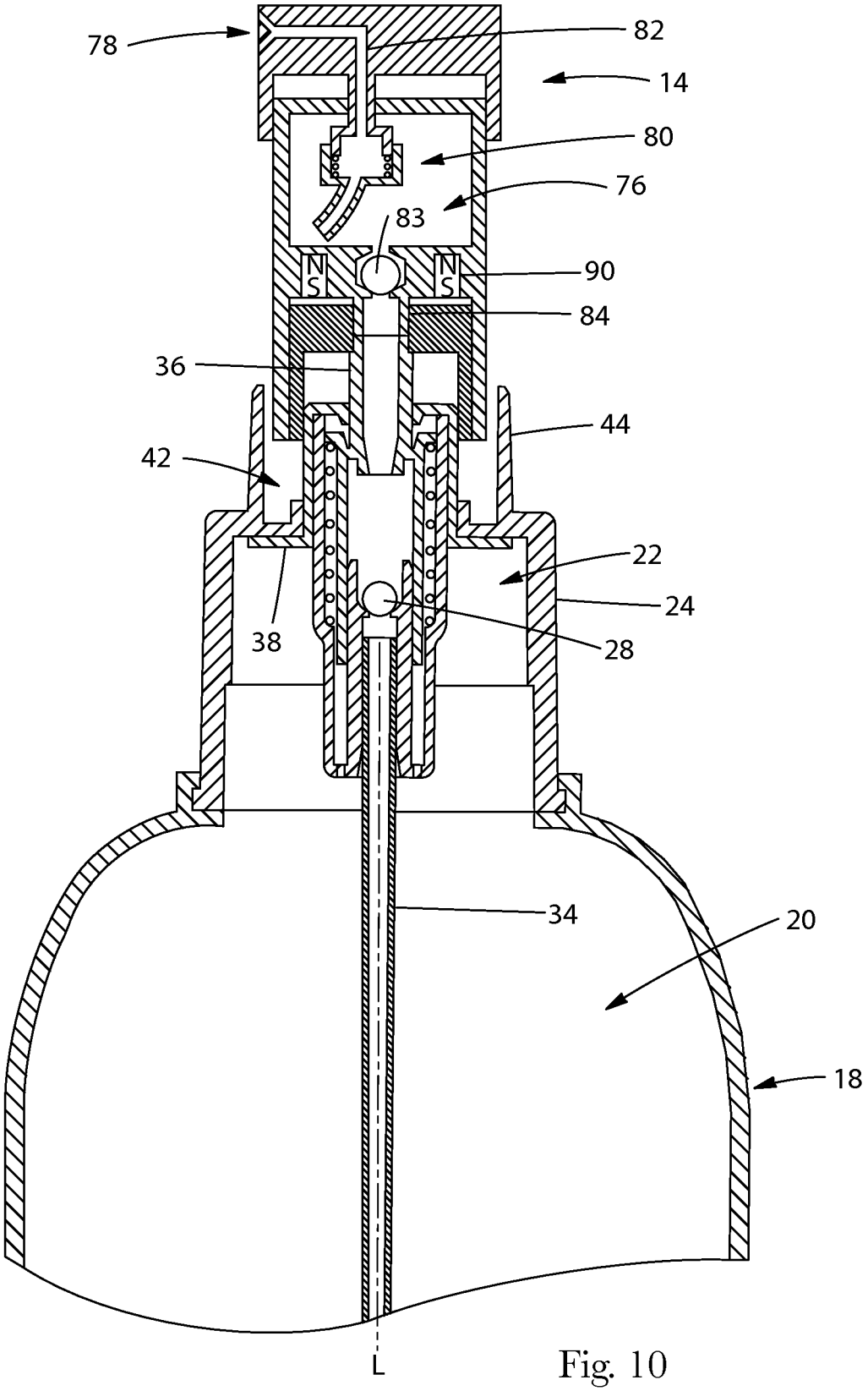
FIG. 10 is a cross-sectional view of the child dispenser of FIG. 7 coupled to the parent dispenser of FIG. 1.

In some embodiments, the child dispenser 14 may be attached to the parent body 18 and refilled using one or more of the following steps. First, the parent actuator 16 is removed from the parent body 18 by applying a force sufficient to overcome the separation force of the first and second magnetic coupling members. Next, the child dispenser 14 may be releasably attached to the parent body 18, as shown by way of example in FIG. 10, by inserting the child inlet tube 84 into the passage 46 until the bottom surface 86 contacts the top surface 50. The child dispenser 14 may then be refilled by translating the child dispenser 14 toward the parent body 18, thereby translating the discharge tube 36 and plunger 32 toward the parent reservoir 20. As the plunger 32 translates toward the parent reservoir, the volume of the pump chamber 26 will decrease. This causes a discharge of fluid from the parent pump chamber 26 thru the discharge tube 36 to the child inlet tube 84 and into the child reservoir 76. Multiple strokes of the child dispenser 14 (and hence the parent pump mechanism 22) can be applied by a user to fill the child reservoir 76 with fluid from the parent reservoir 20. After the child reservoir 76 is filled to the desired level, the child dispenser 14 can be separated from the parent body 18 and the parent actuator 16 may be releasably attached to the parent body 18 as previously described.

Figure 11:
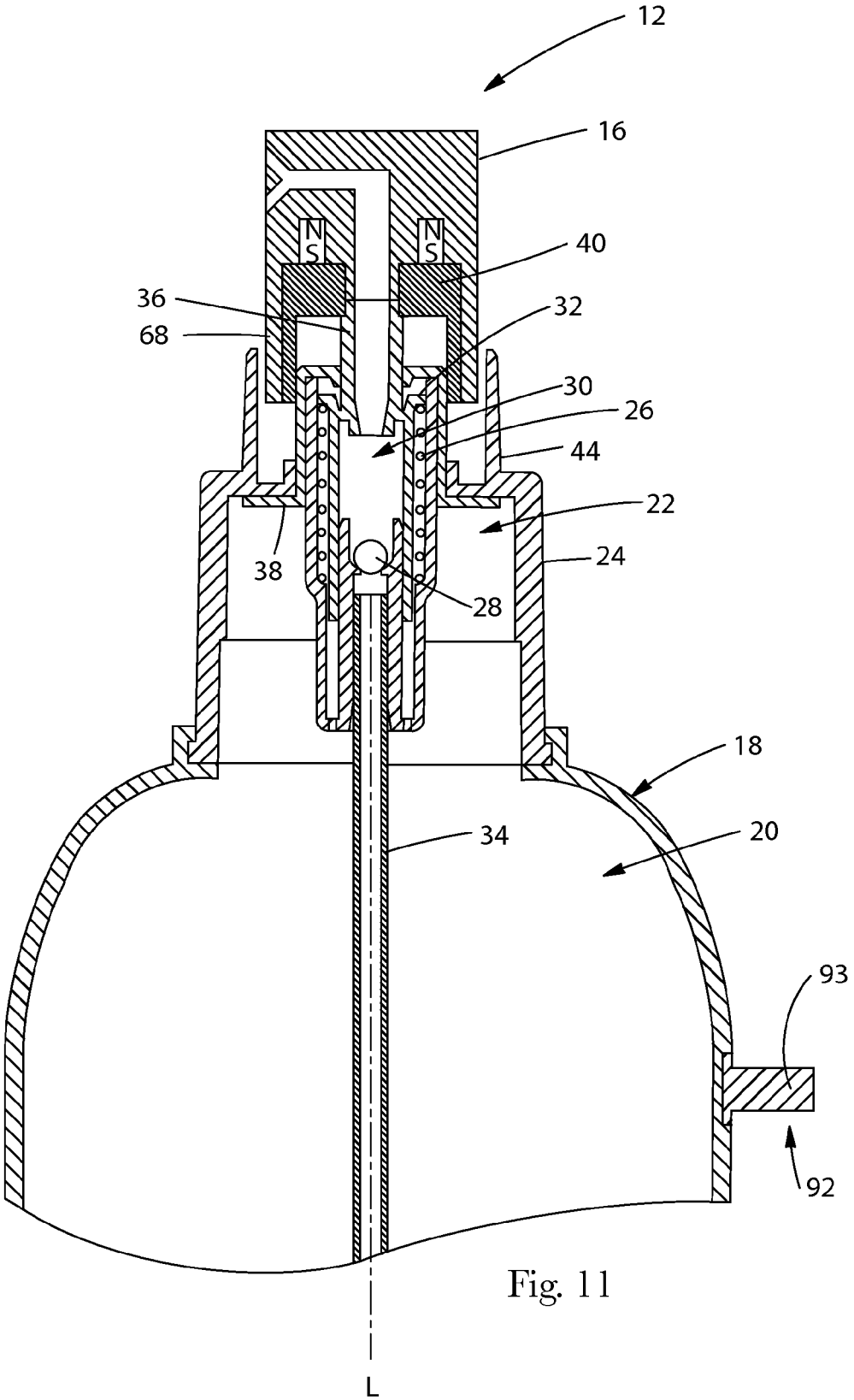
FIG. 11 is a cross sectional view of an alternate embodiment of the parent body of FIG. 2, wherein the parent body comprises an additional magnetic coupling member.
Figure 12:
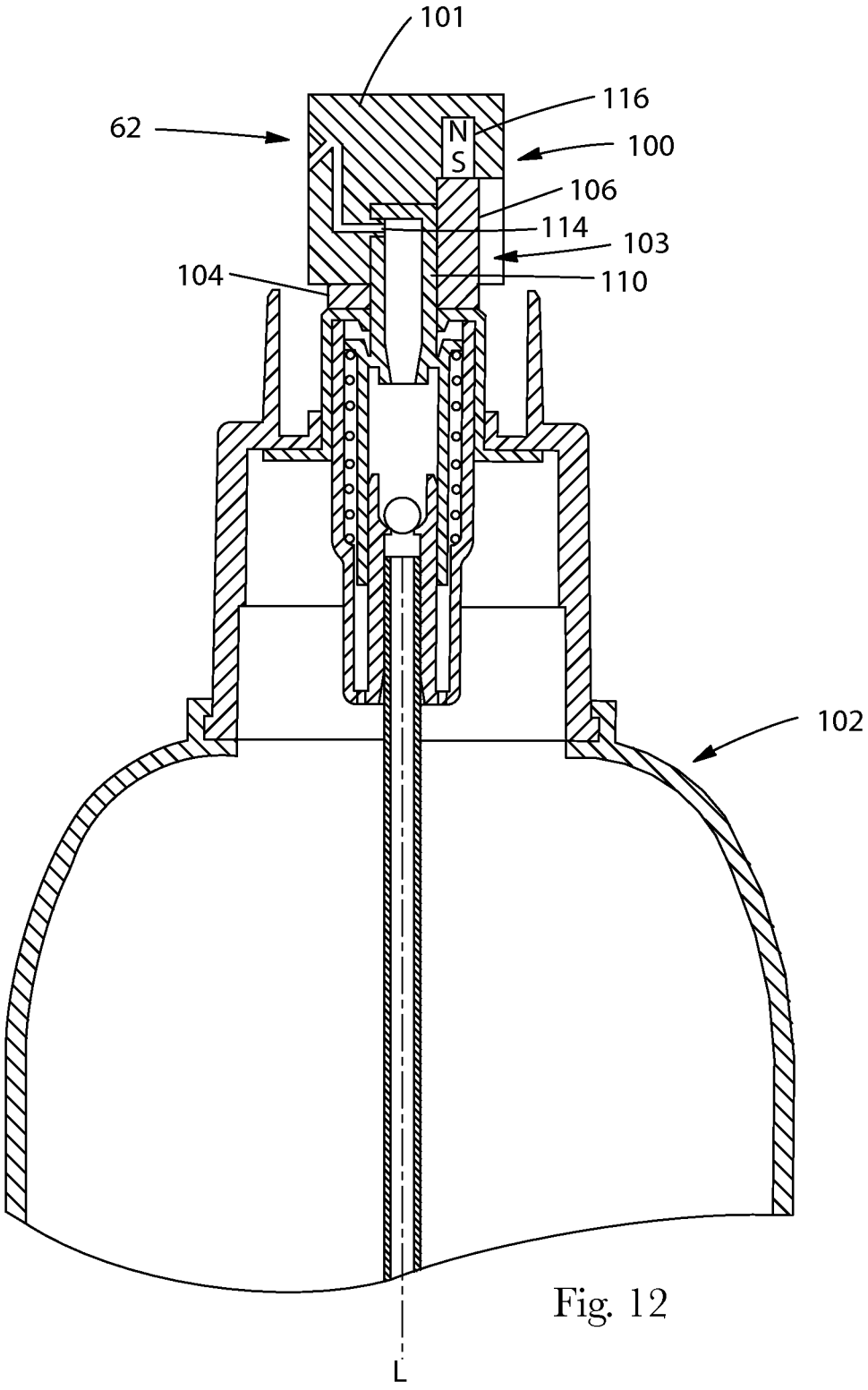
FIG. 12 is a cross sectional view of another alternate embodiment of the parent body and parent actuator of FIG. 2, wherein the parent actuator is transversely attached to the parent body.
Figure 13:
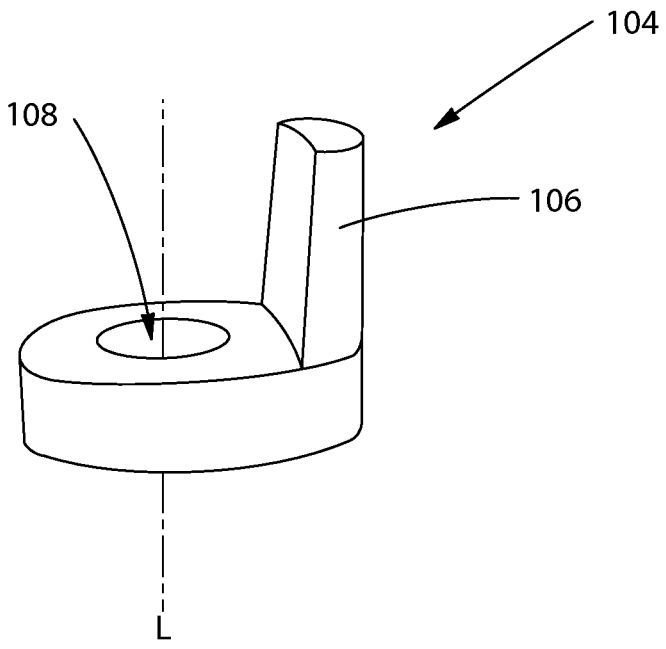
FIG. 13 is a perspective view of the first magnetic coupling member of FIG. 12.
Figure 14:
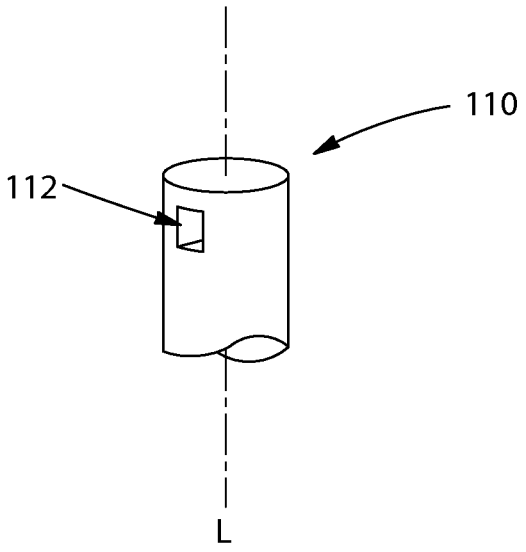
FIG. 14 is a perspective view of the discharge tube of FIG. 12.
Figure 15:
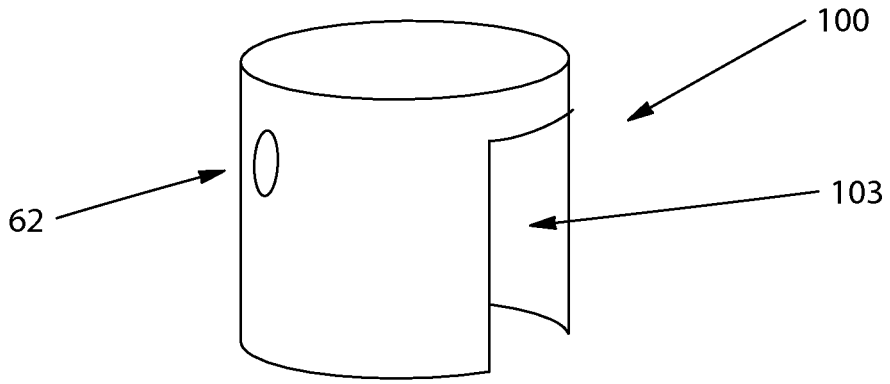
FIG. 15 is a perspective view of the parent actuator of FIG. 12.

Referring to FIG. 11, an alternate embodiment of the present invention incorporating a fourth magnetic coupling member for storing the parent actuator when not in use will now be described. As shown in FIG. 11, the parent body 18 may comprise a fourth magnetic coupling member 92 for releasably securing the parent actuator 16 to the parent body 18 when the parent actuator 16 is separated from the first magnetic coupling member 40. The fourth magnetic coupling member 92 and the second magnetic coupling member 70 are complimentary so that the fourth magnetic coupling member 92 and the second magnetic coupling member 70 cooperate to releasably secure the parent actuator 16 to the parent body 18. In the embodiment shown, the fourth magnetic coupling member 92 comprises a ferromagnetic material 93 at an end thereof that may slide within the skirt 68 of the parent actuator 16 when the parent actuator 16 engages the fourth magnetic coupling member 92. In embodiments where the second magnetic coupling member 70 is provided in the form of a ferromagnetic material, the fourth magnetic coupling member 92 is provided in the form of a semi-permanent/permanent magnet (and vice versa). The fourth magnetic coupling member 92 may be provided in a variety of other configurations and locations on the parent body 18. For example, the fourth magnetic coupling 92 may be embedded within the neck or collar 24 or may be provided near the bottom of the parent body 18 (not shown). In some embodiments, a portion of the outer surface 94 of the parent body may be planar or flat to facilitate securing the parent actuator 16 to the parent body 18 for storage.

Referring to FIGS. 12 to 15, an alternate embodiment of the present invention is illustrated, wherein the parent actuator 100 is releasably attached to the parent body 102 by inserting the parent actuator transversely to a longitudinal axis L of the parent body (versus in a direction of a longitudinal axis as with the embodiment shown in FIG. 2). The parent actuator 100 comprises a parent actuator body 101 having an outlet 62 for dispensing a fluid and a notch 103 for receiving a first magnetic coupling member 104 and discharge tube 110. The first magnetic coupling member 104, which in the embodiment shown is formed from a ferromagnetic material, may be provided in the shape of a ring with an upstanding wall 106. The magnetic coupling member 104 has a hole 108 there through for receiving a discharge tube 110. The discharge tube 110 has an opening 112 therein, wherein the opening is arranged to transverse to the longitudinal axis L of the parent body 102. The opening 112 is configured to receive an inlet tube 114 of the parent actuator 100. The parent actuator 100 further comprises a second magnetic coupling member 116 in the form of a magnet that is disposed adjacent the upstanding wall 106 when the parent actuator 100 is releasably secured to the parent body 18. The first magnetic coupling member 104 and the second magnetic coupling member 116 cooperate to releasably secure the parent actuator 100 to the parent body 18 as previously described. Once coupled, the parent dispenser can be operated in the various manners previously described. As will be appreciated, the configurations of the parent actuator body 101, the notch 103, the discharge tube 110, and parent actuator inlet tube 114 can be varied from the embodiment shown and described herein. In addition, it will be appreciated that other configurations where the parent actuator is attached to the parent body by a combination of motions, such as translating the parent actuator both transverse to and along the longitudinal axis L of the parent body, may also be provided. For example, the first and second magnetic coupling members (40, 70) may be so configured that the second magnetic coupling member does not require complete separation from the first magnetic coupling member in order to remove the parent actuator (100). Alternatively, the separation force to separate the first and second magnetic coupling members (40, 70) may be increased such that application of force by the typical consumer will not result in complete separation. Such embodiments of the advantage of reducing the likelihood of consumers misplacing the second magnetic coupling member.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fluid dispensing system, comprising: a parent dispenser comprising:

(a) a parent body comprising a parent reservoir containing a fluid, a first magnetic coupling member, a passage, and a parent pump mechanism in fluid communication with the parent reservoir and the passage;

(b) a parent actuator for actuating the parent pump mechanism, the parent actuator comprising an outlet, a second magnetic coupling member, and an actuator inlet tube in fluid communication with the outlet, wherein the actuator inlet tube is removably received within the passage and wherein the first magnetic coupling member and the second magnetic coupling member cooperate to removably couple the parent actuator and the parent body;

a child dispenser comprising:

(c) a child body comprising a child reservoir, a child dispensing mechanism, and a child inlet tube, wherein the child inlet tube is removably received within the passage when the child dispenser is coupled to the parent body; and wherein the parent pump mechanism is actuatable by the child dispenser when the child dispenser is coupled to the parent body to transfer at least some of the fluid from the parent reservoir to the child reservoir.

2. The fluid dispensing system of claim 1, wherein the child dispensing mechanism is a child pump mechanism, and wherein the child dispenser comprises:

(d) a child actuator for actuating the child pump mechanism.

3. The fluid dispensing system of claim 1, wherein the first magnetic coupling member comprises at least one magnet generating a magnetic field and the second magnetic coupling member comprises a ferromagnetic material.

4. The fluid dispensing system of claim 1, wherein the first magnetic coupling member comprises a ferromagnetic material and the second magnetic coupling member comprises at least one magnet.

5. The fluid dispensing system of claim 4, wherein the ferromagnetic material is selected from the group consisting of iron, cobalt, and nickel.

6. The fluid dispensing system of claim 4, wherein the first magnetic coupling member has a circular top surface and wherein the passage has an opening disposed in the top surface.

7. The fluid dispensing system of claim 6, wherein the parent actuator has a downwardly depending skirt that encircles the actuator inlet tube and a bottom surface and wherein the bottom surface is disposed adjacent the circular top surface when the parent actuator is coupled to the parent body.

8. The fluid dispensing system of claim 7, wherein the at least one magnet is disposed adjacent the bottom surface of the parent actuator.

9. The fluid dispensing system of claim 6, wherein the parent body further comprises a collar and the first magnetic coupling member is slidably received within the collar.

10. The fluid dispensing system of claim 9, wherein the parent actuator translates the first magnetic coupling member when the parent actuator is depressed by a user and wherein translation of the first magnetic coupling member actuates the parent pump mechanism to pump at least some of the fluid from the parent reservoir to the outlet of the parent actuator.

11. The fluid dispensing system of claim 9, wherein the child body has a downwardly depending skirt that encircles the child inlet tube and a bottom surface and wherein the bottom surface is disposed adjacent the circular top surface of the first magnetic coupling member when the child dispenser is coupled to the parent body.

12. The fluid dispensing system of claim 11, wherein the child dispenser translates the first magnetic coupling member when the child dispenser is depressed by a user and wherein translation of the first magnetic coupling member actuates the parent pump mechanism to pump at least some of the fluid from the parent reservoir to the child reservoir when the child dispenser is coupled to the parent body.

13. The fluid dispensing system of claim 12, wherein the child body further comprises a one-way valve in fluid communication with the child inlet tube and the child reservoir.

14. The fluid dispensing system of claim 1, wherein the passage extends thru the first magnetic coupling member.

15. The fluid dispensing system of claim 1, wherein the parent pump mechanism comprises a piston and a one-way valve.

16. The fluid dispensing system of claim 1, wherein the parent reservoir has a capacity of between about 30 ml and about 300 ml and the child reservoir has a capacity between about 1 ml and about 10 ml.

17. The fluid dispensing system of claim 2, wherein the parent pump mechanism and the child pump mechanism are configured to pump between about 0.05 ml and about 0.15 ml per stroke of the pump mechanism.

18. The fluid dispensing system of claim 1, wherein the fluid is a liquid perfume comprising a fragrance compound.

19. The fluid dispensing system of claim 1, wherein the pump mechanism further comprises a spring and wherein the first magnetic coupling member is biased by the spring.

20. The fluid dispensing system of claim 4, wherein the ferromagnetic material is a metalized plastic.

21. The fluid dispensing system of claim 4, wherein the ferromagnetic material is embedded within a polymeric material.

22. The fluid dispensing system of claim 4, wherein the at least one magnet comprises a plurality of magnets.

23. The fluid dispensing system of claim 4, wherein the child dispenser further comprises a third magnetic coupling member.

24. The fluid dispensing system of claim 23, wherein the third magnetic coupling member comprises a magnet.

* * * * *